US009063459B2

(12) United States Patent
Yamanaka

(10) Patent No.: US 9,063,459 B2
(45) Date of Patent: Jun. 23, 2015

(54) TONER CASE AND IMAGE FORMING APPARATUS

(71) Applicant: KYOCERA DOCUMENT SOLUTIONS INC., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 36 days.

(21) Appl. No.: 13/954,643

(22) Filed: Jul. 30, 2013

(65) Prior Publication Data

US 2014/0037342 A1 Feb. 6, 2014

(30) Foreign Application Priority Data

Jul. 31, 2012 (JP) ..... 2012-169990

(51) Int. Cl.
*G03G 15/08* (2006.01)

(52) U.S. Cl.
CPC ..... *G03G 15/0834* (2013.01); *G03G 15/0875* (2013.01); *G03G 2215/0802* (2013.01); *G03G 15/0868* (2013.01)

(58) Field of Classification Search
CPC ..... G03G 15/0832; G03G 15/0834; G03G 15/0836; G03G 15/0837; G03G 15/0865; G03G 15/0875; G03G 2215/066; G03G 2215/068; G03G 2215/0685
USPC ..... 399/119, 262, 263
See application file for complete search history.

(56) References Cited

U.S. PATENT DOCUMENTS

| | | | | |
|---|---|---|---|---|
| 5,697,022 | A * | 12/1997 | Matsuda et al. | 399/102 |
| 7,362,986 | B2 * | 4/2008 | Okabe et al. | 399/111 |
| 7,529,502 | B2 * | 5/2009 | Okabe et al. | 399/111 |
| 8,170,442 | B2 * | 5/2012 | Sato et al. | 399/103 |
| 2011/0103846 | A1 * | 5/2011 | Ota | 399/263 |
| 2012/0034001 | A1 * | 2/2012 | Sato | 399/262 |
| 2013/0259537 | A1 * | 10/2013 | Matsumoto et al. | 399/263 |

FOREIGN PATENT DOCUMENTS

| | | | | |
|---|---|---|---|---|
| JP | 2008129152 | A * | 6/2008 | G03G 15/08 |
| JP | 2010-169977 | A | 8/2010 | |

OTHER PUBLICATIONS

Machine Translation of JP 2008-129152. Jun. 5, 2008.*

* cited by examiner

*Primary Examiner* — David Gray
*Assistant Examiner* — Carla Therrien
(74) *Attorney, Agent, or Firm* — Studebaker & Brackett PC

(57) ABSTRACT

A toner case includes a main body, a cover, a rotating member, an agitating member, a protrusion arrangement part and a depression arrangement part. The main body has a first wall, a second wall, a third wall, a fourth wall, a bottom board, an opening at an upper side and a toner discharge port discharging a toner stored inside to an outside. The protrusion arrangement part is formed on one of an upper face facing upward formed in the first or second wall and a lower face facing to the upper face formed in the cover. The protrusion arrangement part has a plurality of protrusions arranged in the direction from the third wall to the fourth wall. The depression arrangement part is formed on another of the upper and lower faces. The depression arrangement part has a plurality of depressions, into which the protrusions insert, arranged in the direction.

17 Claims, 9 Drawing Sheets

TONER CASE AND IMAGE FORMING APPARATUS

INCORPORATION BY REFERENCE

This application is based on and claims the benefit of priority from Japanese Patent application No. 2012-169990 filed on Jul. 31, 2012, the entire contents of which are incorporated herein by reference.

BACKGROUND

The present disclosure relates to a toner case storing a toner (developer) used in a dry electro photographic print method and an image forming apparatus to which the toner case is attached.

Generally, a toner case (e.g. a toner cartridge) storing a toner used in a dry electro photographic print method includes a main body and a cover. The main body is formed in a box-liked shape, has an opening at an upper side and stores the toner inside. The cover is attached to the upper side of the main body to close the opening. In the main body or cover, a toner discharge port is formed so as to discharge the toner stored in the main body to a development device of the image forming apparatus. In the toner case, a toner agitating mechanism is provided so as to agitate the toner stored in the main body and to send the toner to a side of the toner discharge port.

The toner agitating mechanism includes, for example, a rotating member and an agitating member. The rotating member is, for example, a bar-formed member extending in left and right directions in the main body and has both ends rotatably supported in the main body. The agitating member is, for example, a board-formed member and has a base end side connected with the rotating member in the main body. When the agitating member rotates accompanying to rotation of the rotating member, the toner stored in the main body is agitated by a top end side of the agitating member.

When the agitating member rotates, the top end of the agitating member is moved while keeping in contact with a given area in an internal face of the main body and an internal face of the cover. Hereinafter, the above-mentioned given area is called as an "internal contact face". Because the agitating member is made of a flexible material, when the agitating member rotates, the agitating member is elastically deformed between the rotating member and the internal contact face. Therefore, the top end of the agitating member is moved in a state keeping in contact with the internal contact face by suitable pressing force. Thereby, the toner stored in the main body is sufficiently agitated.

An outside shell of the toner case is formed by combining the separately molded main body and cover with each other. Therefore, a gap or a level difference may be formed in the boundary between the main body and cover Due to the structure of the toner case, the boundary between the main body and cover is exposed to an inside of the toner case and may be located in the internal contact face. Thus, in a case where the boundary between the main body and cover is located in the internal contact face, there is a problem that a noise called as a crack or a flick occurs when the agitating member rotates.

Cause of such a noise is mentioned below. That is, the top end of the agitating member is moved in the state keeping in contact with the internal contact face as mentioned above. While the top end of the agitating member is moved in the boundary between the main body and cover, because the top end of the agitating member runs over a gap or a level difference formed in the boundary, the top end is separated from the internal contact face for a moment and comes into contact with it again. Then, the top end of the agitating member strongly hits the boundary by the elastic force of the agitating member, thereby causing the noise.

Moreover, in the case where the boundary between the main body and cover is located in the internal contact face as mentioned above, there is another problem that it is feared that the agitating member is damaged by inserting the top end of the agitating member in the gap or level difference formed in the boundary when the agitating member rotates. Particularly, when the agitating member rotates in a reverse direction of a usual rotating direction, the agitating member may deeply insert in the gap or level difference in the boundary. In such a case, a danger of breaking the agitating member increases. The reverse rotation of the agitating member may be caused, for example, in the following case. That is, at an outer face side of the toner case, a rotation transmitting member is exposed, which transmits a rotating power from the image forming apparatus to the rotating member of the toner case when the toner case is attached to the image forming apparatus. When the toner case is attached to or detached from the image forming apparatus, the rotation transmitting member may hit any object so that the rotating member rotates in the reverse direction.

SUMMARY

In accordance with an embodiment of the present disclosure, a toner case includes a main body, a cover, a rotating member, an agitating member, a protrusion arrangement part and a depression arrangement part. The main body has a first wall, a second wall, a third wall, a fourth wall, a bottom board. The second wall faces to the first wall. The third wall extends in a direction crossing to the first wall and second wall. The fourth wall faces to the third wall. The main body has an opening at an upper side. The main body has a toner discharge port discharging a toner stored inside to an outside. The cover is attached to the upper side of the main body to close the opening. The rotating member is located in the main body. The rotating member rotates around a rotation axis extending in a direction from the third wall to the fourth wall in the main body. The agitating member has a base end side supported by the rotating member to rotate in the main body by a rotation of the rotating member. The agitating member agitates the toner stored in the main body by a top end side and transmits the toner to the toner discharge port. The protrusion arrangement part is formed on one of an upper face formed in the first wall or the second wall so as to face upward and a lower face formed in the cover so as to face to the upper face. The protrusion arrangement part has a plurality of protrusions arranged in the direction from the third wall to the fourth wall. The depression arrangement part is formed on another of the upper face and lower face. The depression arrangement part has a plurality of depressions, into which the plurality of protrusions insert, arranged in the direction.

Furthermore, in accordance with an embodiment of the present disclosure, an image forming apparatus includes a toner case. The toner case includes a main body, a cover, a rotating member, an agitating member, a protrusion arrangement part and a depression arrangement part. The main body has a first wall, a second wall, a third wall, a fourth wall, a bottom board. The second wall faces to the first wall. The third wall extends in a direction crossing to the first wall and second wall. The fourth wall faces to the third wall. The main body has an opening at an upper side. The main body has a toner discharge port discharging a toner stored inside to an outside. The cover is attached to the upper side of the main body to close the opening. The rotating member is located in the main body. The rotating member rotates around a rotation axis extending in a direction from the third wall to the fourth wall in the main body. The agitating member has a base end side supported by the rotating member to rotate in the main body by a rotation of the rotating member. The agitating member agitates the toner stored in the main body by a top end side and transmits the toner to the toner discharge port. The protrusion arrangement part is formed on one of an upper face formed in the first wall or the second wall so as to face upward and a lower face formed in the cover so as to face to the upper face. The protrusion arrangement part has a plurality of protrusions arranged in the direction from the third wall to the fourth wall. The depression arrangement part is formed on another of the upper face and lower face. The depression arrangement part has a plurality of depressions, into which the plurality of protrusions insert, arranged in the direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, an embodiment of the present disclosure will be described with reference to the drawings.

Figure 1:
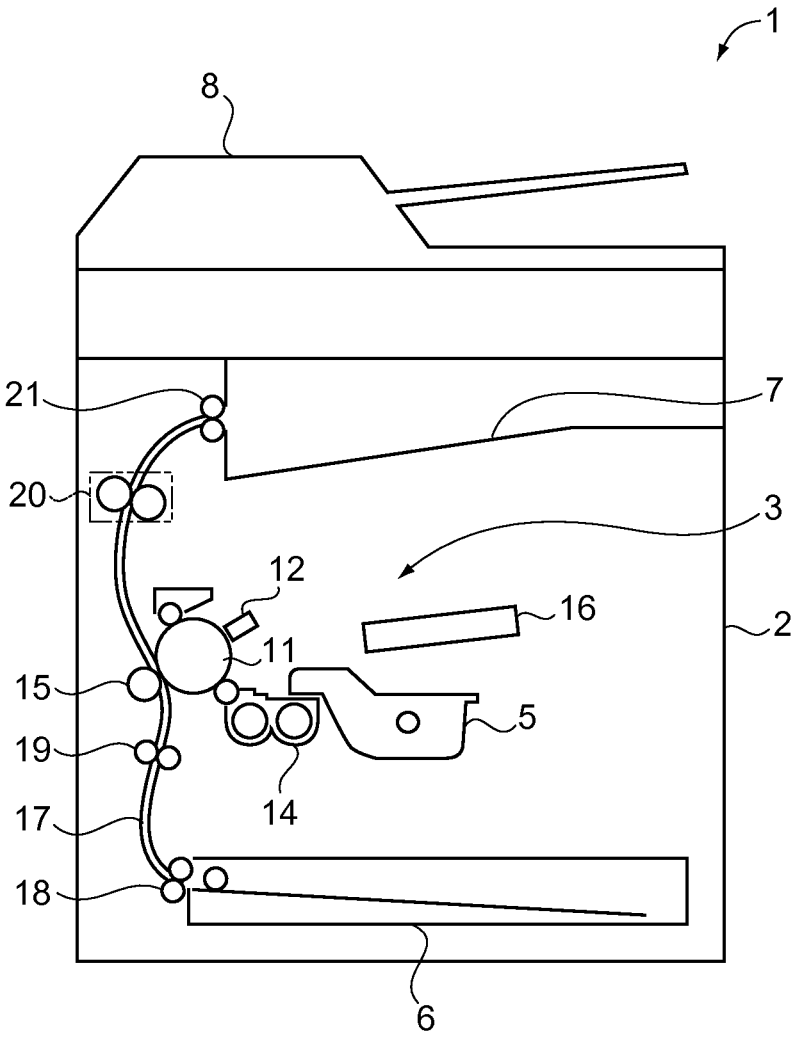
FIG. 1 is a schematic diagram schematically showing an image forming apparatus, to which a toner case is attached, according to an embodiment of the present disclosure.

FIG. 1 shows an image forming apparatus, to which a toner case is attached, according to the embodiment of the present disclosure.

In FIG. 1, the image forming apparatus 1 is an apparatus, for example, such as a multifunction machine, a printer, a copying machine or a facsimile, having a printing function printing an image inputted from the exterior to a recording medium, such as a sheet. The image forming apparatus 1 applies as a print method a dry electro photographic method applied in a usual laser printer. The image forming apparatus 1 has a monochrome print function, but the disclosure can be applied to another image forming apparatus having a color print function.

In a housing 2 of the image forming apparatus 1, an image forming part 3 printing the image inputted from the exterior to the sheet is provided. Moreover, to the housing 2 of the image forming apparatus 1, a toner case 5 according to the embodiment of the present disclosure is attached. The toner case 5 is, for example, a toner cartridge being attachable/detachable to the housing 2 of the image forming apparatus 1. In a lower part of the housing 2, a sheet feeding tray 6 storing the sheets is attached and, in an upper part of the housing 2, an ejecting tray 7 ejecting the sheet with a completed image print is formed. In addition, above the housing 2, an image reading apparatus 8 reading an image from a document is provided.

The image forming part 3 includes a photosensitive drum 11, a charging part 12, an exposing part (not shown), a developing part 14 and a transfer roller 15. The image forming part 3 also includes an image data processing unit 16. The image data processing unit 16 receives image data inputted from the exterior and controls the exposing part in accordance with the image data. The image data is, for example, transmitted from a personal computer or the like connected with the image forming apparatus 1 via a cable, a computer network or a communication line or the like to the image forming apparatus 1 or read from the document by the image reading apparatus 8. In addition, in a sheet conveying path 17 of the image forming part 3, a sheet feeding roller unit 18, a conveying roller unit 19, a fixing part 20 and an ejecting roller unit 21 are arranged. The sheet feeding roller unit 18 feeds the sheet from the sheet feeding tray 6. The conveying roller unit 19 conveys the sheet to the transfer roller 15. The fixing part 20 fixes the image transferred on the sheet. The ejecting roller unit 21 conveys the sheet with the fixed image to the ejecting tray 7.

Figure 2:
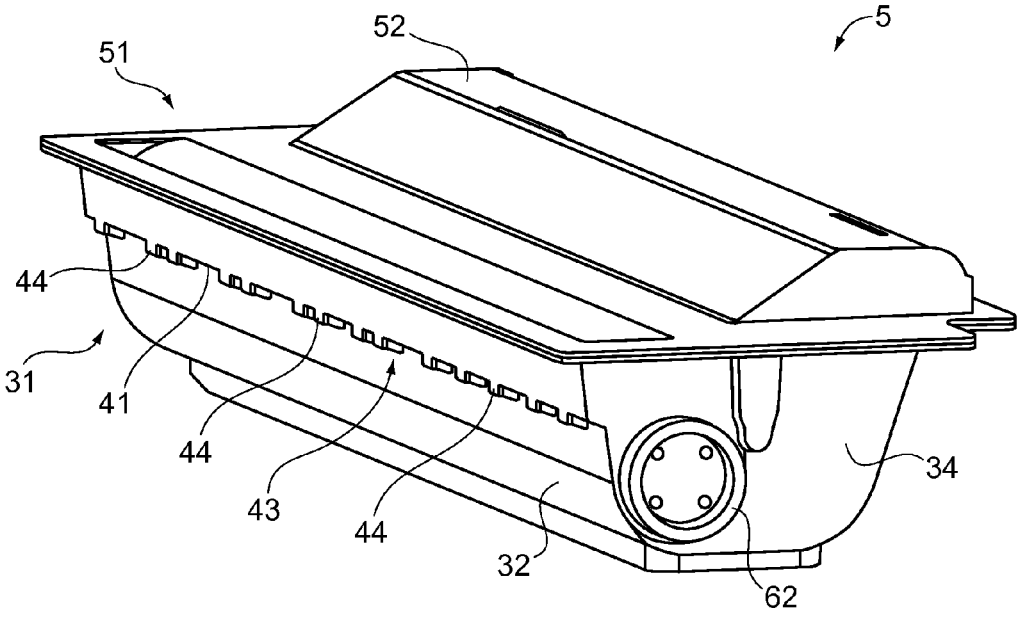
FIG. 2 is an appearance perspective view showing the toner case according to the embodiment of the present disclosure.
Figure 3:
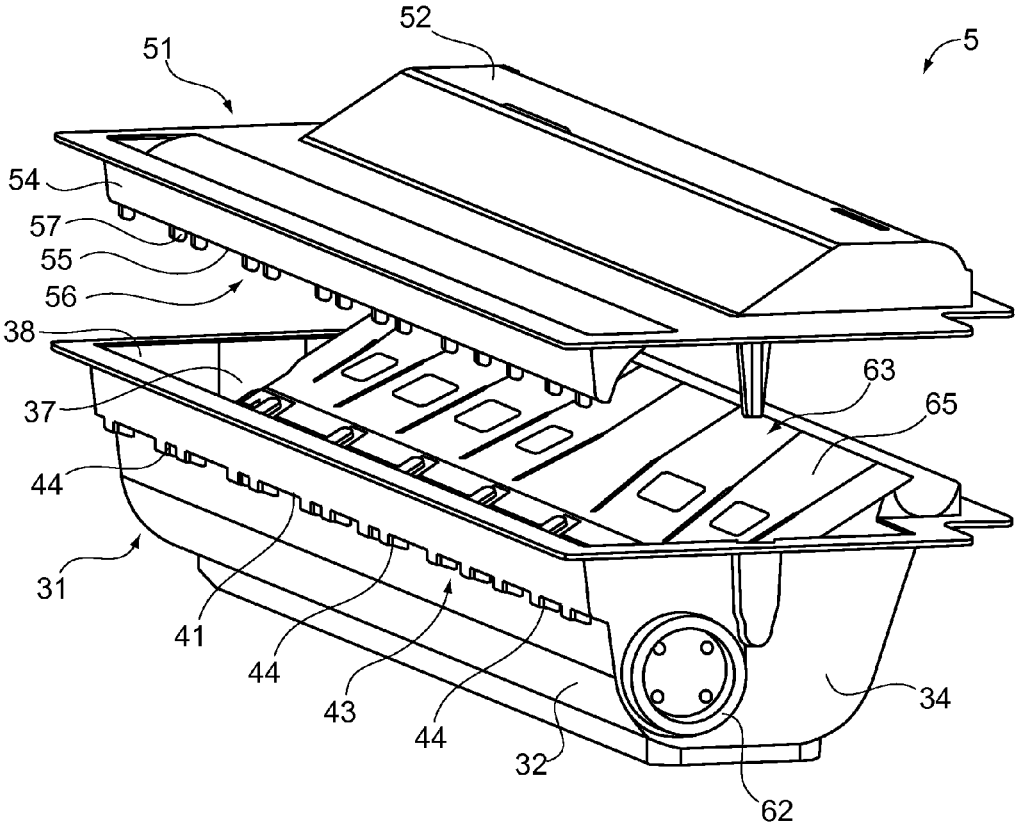
FIG. 3 is a perspective view showing the toner case of FIG. 2 in a situation, in which a main body and a cover are separated.
Figure 4:
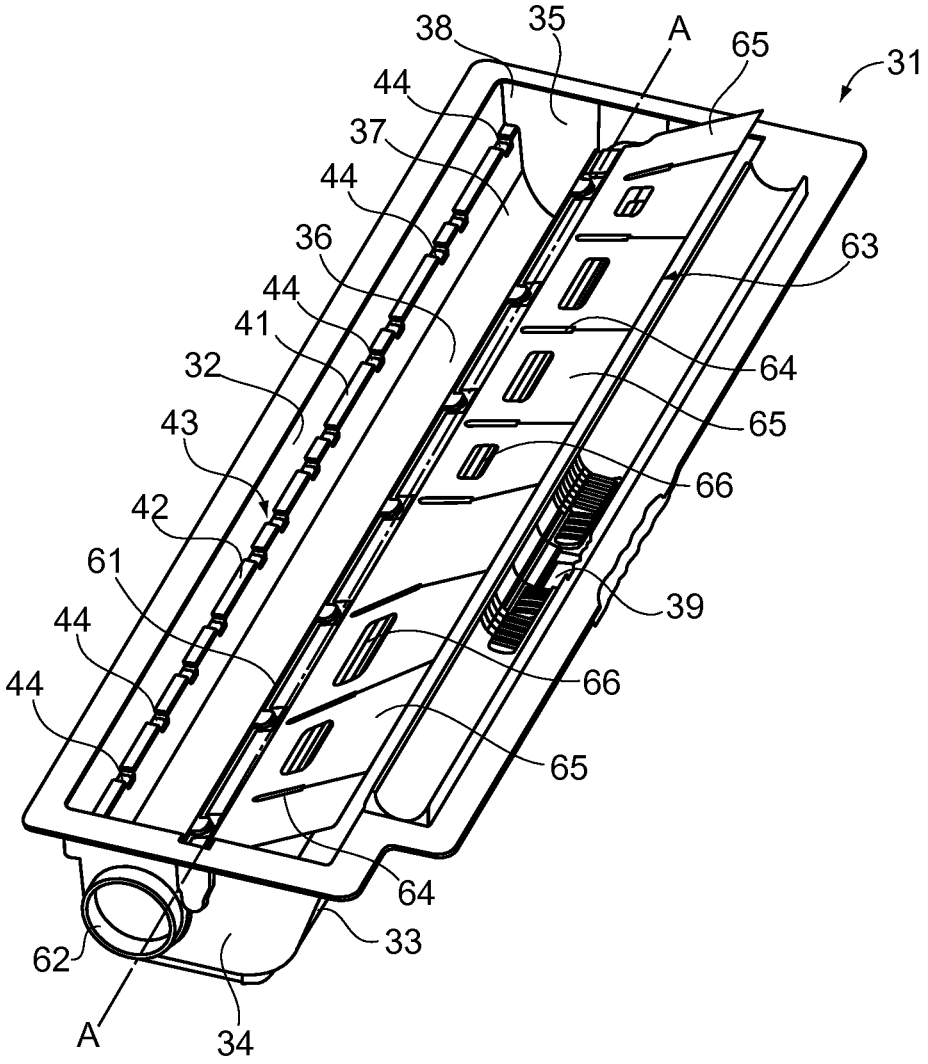
FIG. 4 is a perspective view showing the main body of the toner case of the FIG. 2.
Figure 5:
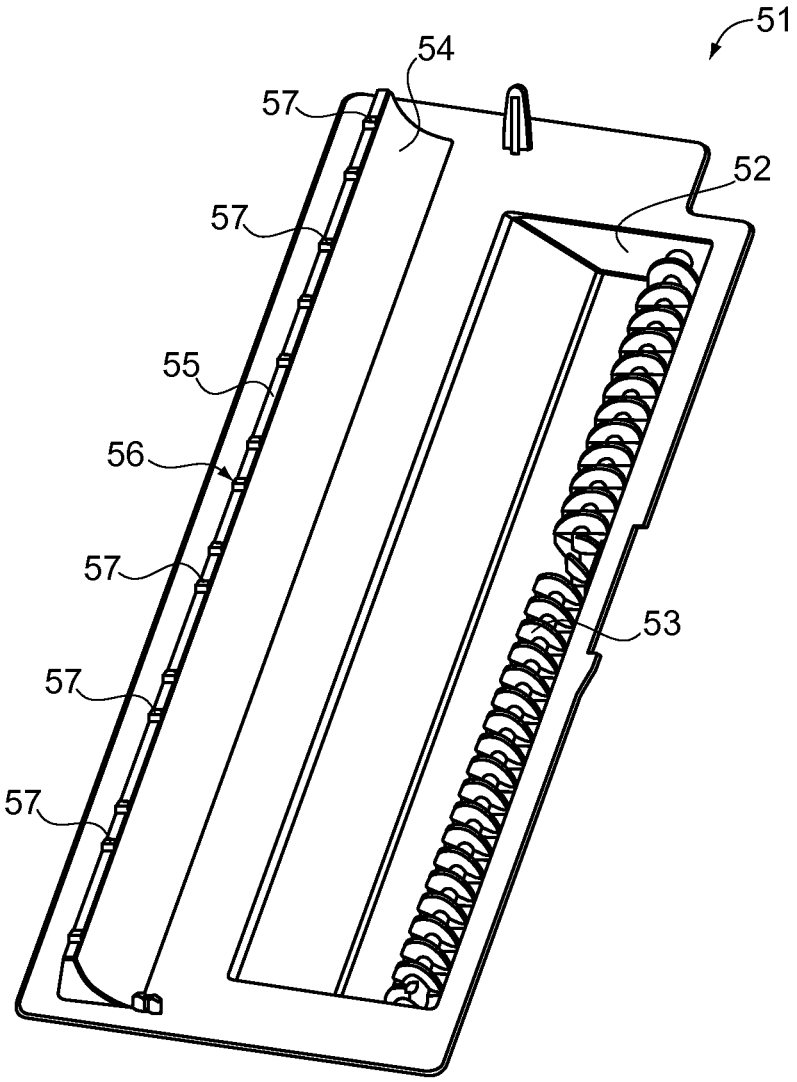
FIG. 5 is a perspective view showing the cover of the toner case of the FIG. 2.
Figure 6:
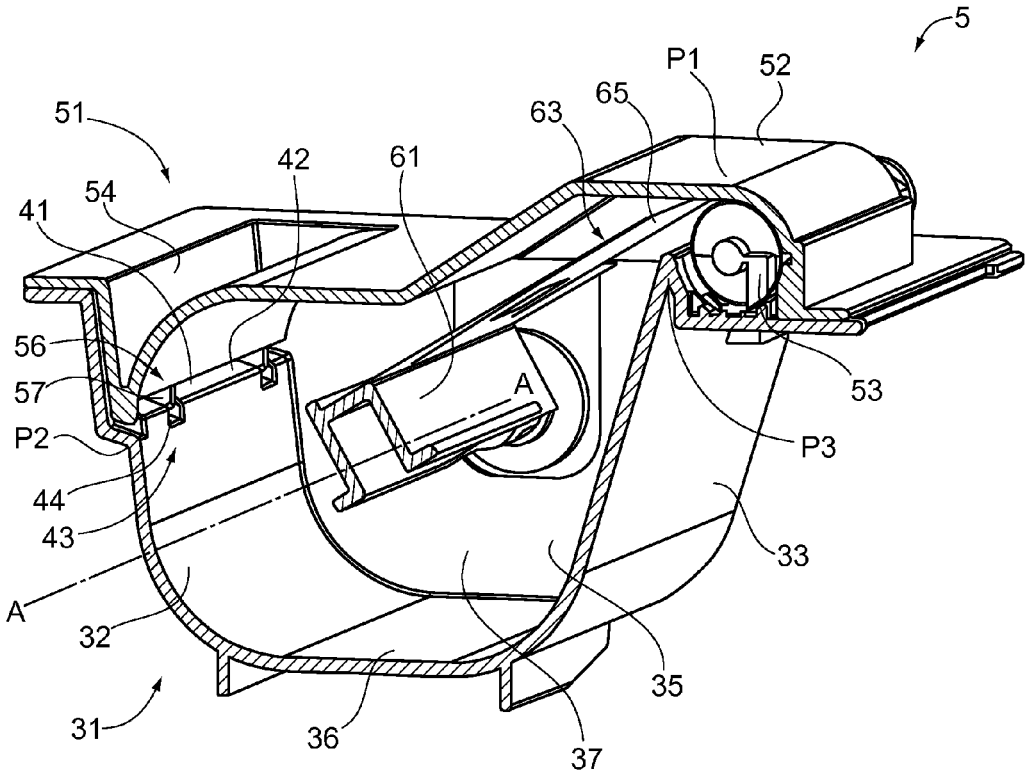
FIG. 6 is a perspective view showing an inside of the toner case of the FIG. 2.
Figure 7:
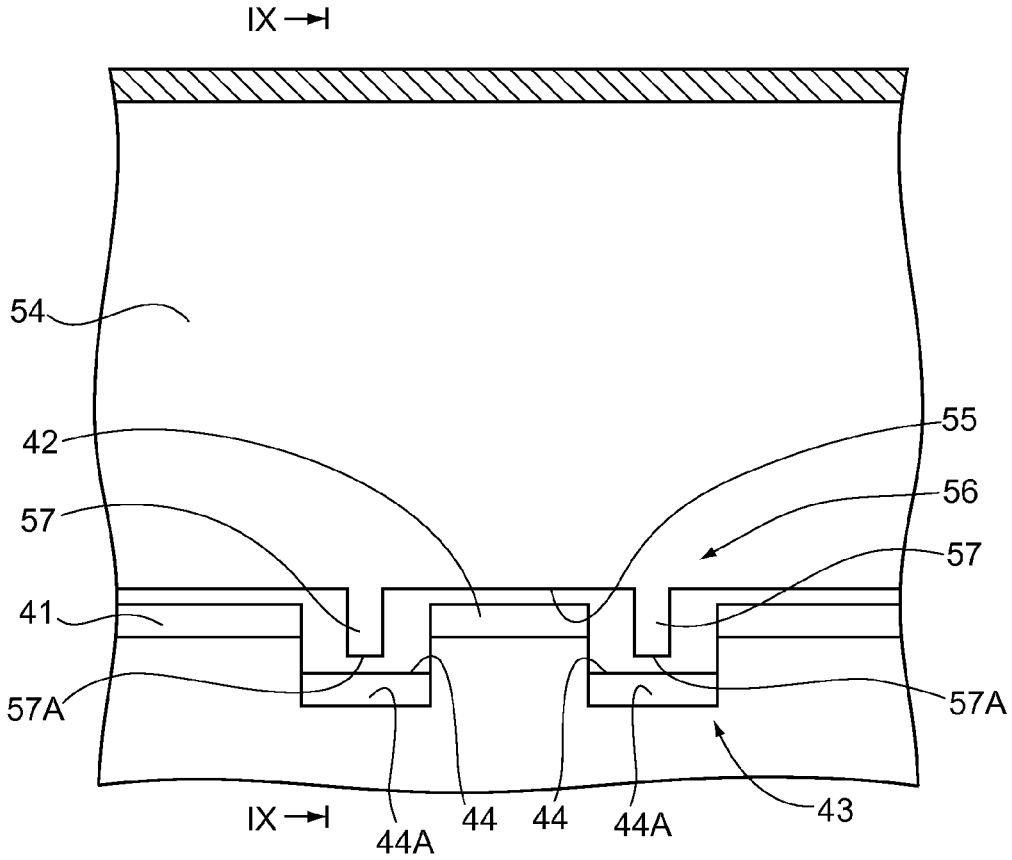
FIG. 7 is an enlarged view showing a boundary between the main body and cover of the toner case according to the embodiment of the present disclosure.

FIGS. 2-7 illustrate the toner case 5 according to the embodiment of the present disclosure. In detail, FIG. 2 shows an appearance of the toner case 5 and FIG. 3 shows a situation, in which a main body 31 and a cover 51 of the toner case 5 are separated. FIG. 4 shows the main body 31 of the toner case 5 and FIG. 5 shows the cover 51 of the toner case 5. FIG. 6 shows an inside of the toner case 5 and FIG. 7 shows a boundary between the main body 31 and cover 51 of the toner case 5.

As shown in FIG. 2, the toner case 5 is a toner storing device configured to store a toner (a developer) inside and to supply the toner to the developing part 14. The toner case 5 includes the main body 31 and cover 51 and the main body 31 and cover 51 can be separated from each other as shown in FIG. 3.

The main body 31 is, for example, formed in a box-liked shape of resin material. The main body 31 includes, as shown in FIG. 4, a front wall 32, a back wall 33, a left wall 34, a right wall 35 and a bottom board 36. By front wall 32, back wall 33, left wall 34, right wall 35 and bottom board 36, a toner storing space 37 is arranged and the toner is stored in the toner storing space 37. One of the front wall 32 and back wall 33 is a concrete example of a first wall and another of the front wall 32 and back wall 33 is a concrete example of a second wall. One of the left wall 34 and right wall 35 is a concrete example of a third wall and another of the left wall 34 and right wall 35 is a concrete example of a fourth wall.

In an upper part of the front wall 32 of the main body 31, a fitting step part 41 protruded forward is formed. The fitting step part 41 extends in a straight line-liked form from a left end to a right end of the main body 31 in a left/right direction (in a direction from the left wall 34 to the right wall 35). On the fitting step part 41, an upper face 42 facing upward is formed. The fitting step part 41 fits to a fitting protrusion 54 of the cover 51.

In an upper side of the main body 31, an opening 38 is formed. As shown in FIG. 4, in an upper side of the back wall 33 of the main body 31, a toner discharge port 39 is formed so as to discharge the toner stored in the main body 31 to the outside of the toner case 5, concretely the developing part 14.

The cover 51 is, for example, formed in a roughly board-liked shape of resin material. The cover 51 is attached, as shown in FIG. 2, to the upper side of the main body 31. By attaching the cover 51 to the main body 31, the opening 38 of the main body 31 is closed. In a back side of the cover 51, a toner discharging part 52 partly expanded above is formed. An inside of the toner discharging part 52 communicates, as shown in FIG. 6, to the toner storing space 37.

Inside the toner discharging part 52, as shown in FIG. 5, a screw 53 discharging the toner to the toner discharge port 39 is provided. The screw 53 is rotatably supported between a left wall and a right wall of the toner discharging part 52. The toner is transmitted from the toner storing space 37 to the inside of the toner discharging part 52 by the below-mentioned agitating member 63 and transmitted from the toner discharging part 52 to the toner discharge port 39 by the screw 53. The toner transmitted to the toner discharging part 52 securely can be discharged from the toner discharge port 39 to the outside by the screw 53. Due to the structure supporting the below-mentioned agitating member 63 to a side of the main body 31 and supporting the screw 53 to another side of the cover 51, when the toner case 5 is fabricated, first, the agitating member 63 is attached to the main body 31 and the screw 53 is attached to the cover 51. Subsequently, the main body 31 to which the agitating member 63 is attached and the cover 51 to which the screw 53 is attached are combined. It is therefore possible to facilitate the fabrication of the toner case 5.

As shown in FIG. 3, at a bottom face side of a front part of the cover 51, the fitting protrusion 54 partly protruded below is formed. The fitting protrusion 54 extends in a straight line-liked form in the left/right direction so as to correspond with the fitting step part 41 of the main body 31. On a bottom end of the fitting protrusion 54, a lower face 55 facing downward is formed. The fitting protrusion 54 fits to the fitting step part 41 of the main body 31

In the main body 31, as shown in FIG. 4, a toner agitating mechanism is provided. The toner agitating mechanism includes a rotating member 61, a rotation transmitting member 62 and the agitating member 63. The rotating member 61 extends in the left/right direction, its left end is rotatably supported by the left wall 34 and its right end is rotatably supported by the right wall 35. Thereby, the rotating member 61 can rotates around a rotation axis A-A extending in the left/right direction in the main body 31.

The rotation transmitting member 62 is rotatably supported in a left face (an outside face) of the left wall 34 of the toner case 5. Between the rotating member 61 and rotation transmitting member 62, another mechanism (not shown) transmitting the rotation of the rotation transmitting member 62 to the rotating member 61 is arranged.

The agitating member 63 is formed in a plate-liked shape of a flexible material. The agitating member 63 is located in the main body 31 so that its longitudinal direction is in parallel with the rotation axis A-A and its short direction crosses at a right angle to the rotation axis A-A. A base end side of the agitating member 63 is supported (fixed) by the rotating member 61 and a top end side of the agitating member 63 extends from the rotating member 61 in a direction crossing at a right angle to the rotation axis A-A. The agitating member 63 rotates in the main body 31 accompanying to the rotation of the rotating member 61 so that the top end side agitates the toner stored in the toner storing space 37 and transmits the toner to a side of the toner discharge port 39. In the agitating member 63, a plurality of slits 64 are formed from the top end to the base end side and, by these slits 64, a top end side of the agitating member 63 is divided into a plurality of plate pieces 65. In the plurality of plate pieces 65, hales 66 are formed.

When the toner case 5 is attached to a predetermined position in the housing 2 of the image forming apparatus 1, the rotation transmitting member 62 attached to the left wall 34 of the toner case 5 is connected with a driving member (not shown) provided in the image forming apparatus 1. Thereby, while the image forming apparatus 1 is activated, the rotating power generated by a rotating power source (not shown) provided in the image forming apparatus 1 is transmitted via the driving member and rotation transmitting member 62 to the rotating member 61, and then, the rotating member 61 rotates in a counter clockwise direction in FIG. 6.

When the rotating member 61 rotates, the top end of each plate piece 65 of the agitating member 63 is moved while keeping in contact with a given area (an internal contact face) in an internal face of the main body 31 and an internal face of the cover 51. In the embodiment, in the internal face of the main body 31 and the internal face of the cover 51, an area from a position P1 via a position P2 to a position P3 in FIG. 6 is the internal contact face.

Because the agitating member 63 is made of the flexible material, when the agitating member 63 rotates, the agitating member 63 is elastically deformed between the rotating member 61 and internal contact face. Therefore, the top end of each plate piece 65 is moved in a state keeping in contact with the internal contact face by suitable pressing force. Thereby, it is possible to sufficiently agitate the toner stored in the main body 31, and moreover, even if a residual quantity of the toner in the toner storing space 37 is decreased, to surely transmit the toner to the toner discharge port 39.

As shown in FIG. 6, in the main body 31, a part from a lower part of the front wall 32 to a front part of the bottom board 36 and another part from a back part of the bottom board 36 to a lower part of the back wall 33 are gently curved so as to draw an arc, respectively. A rear part of the fitting protrusion 54 is gently curved so as to draw an arc to an intermediate part in a forward/backward direction of the cover 51. Due to such structures, the internal contact face is flat or gently curved face without a sharply bended part and roughness from the position P1 via the position P2 to the position P3 except for a boundary between the fitting step part 41 of the main body 31 and the fitting protrusion 54 of the cover 51. Therefore, while the top end of each plate piece 65 of the agitating member 63 is moved on the internal contact face accompanying to the rotation of the rotating member 61, the top end of each plate piece 65 is kept in a contact state with the internal contact face except for the boundary between the fitting step part 41 of the main body 31 and the fitting protrusion 54 of the cover 51. As a result, while the top end of each plate piece 65 is moved on the internal contact face except for the boundary between the fitting step part 41 of the main body 31 and the fitting protrusion 54 of the cover 51, a noise called as a crack or a flick is restrained and there is no addition of excessive outer force to the agitating member 63 and no damage of the agitating member 63.

On the other hand, in the vicinity of the position P2, the boundary between the fitting step part 41 of the main body 31 and the fitting protrusion 54 of the cover 51 is exposed to the internal contact face and the boundary is located in the internal contact face. As shown in FIG. 6 or 7, the fitting step part 41 of the main body 31 and the fitting protrusion 54 of the cover 51 are not closely adhered, that is, a gap is formed between both. Therefore, there is a gap in a part in the internal contact face locating the boundary between the fitting step part 41 of the main body 31 and the fitting protrusion 54 of the cover 51. However, the toner case 5 according to the embodiment of the present disclosure has a structure keeping the contact state between the top end of each plate piece 65 of the agitating member 63 and the internal contact face even the part locating the boundary between the fitting step part 41 of the main body 31 and the fitting protrusion 54 of the cover 51.

That is, in the upper face 42 of the fitting step part 41 of the main body 31, as shown in FIG. 4, a depression arrangement part 43 arranging in the left/right direction a plurality of depressions 44 extending in an upward/downward direction is formed. On the other hand, in the lower face 55 of the fitting protrusion 54 of the cover 51, as shown in FIG. 5, a protrusion arrangement part 56 arranging in the left/right direction a plurality of protrusions 57 extending in the upward/downward direction is formed. The number and arrangement of the depressions 44 correspond to the number and arrangement of the protrusions 57. In a situation combining the main body 31 and cover 51, as shown in FIG. 6, the plurality of the protrusions 57 of the protrusion arrangement part 56 respectively insert into the plurality of the depressions 44 of the depression arrangement part 43. That is, the depression arrangement part 43 and protrusion arrangement part 56 are fitted to each other. In the embodiment, as shown in FIG. 7, a slight gap is formed between the depression arrangement part 43 and protrusion arrangement part 56. However, an extruded end of each extrusion 57 extruded below from the lower face 55 of the fitting protrusion 54 surely inserts into each depression 44 depressed below from the upper face 42 of the fitting step part 41 and an extruded end face 57A of each extrusion 57 is positioned below the upper face 42. Therefore, the gap formed in the boundary between the fitting step part 41 of the main body 31 and the fitting protrusion 54 of the cover 51 is not a consistent straight line-liked extending form from the left end to the right end of the main body 31 in the left/right direction, but is another form arranging several protrusions and depressions, that extend in the upward/downward direction, from the left end to the right end of the main body 31 in the left/right direction.

Thus, in the boundary between the fitting step part 41 of the main body 31 and the fitting protrusion 54 of the cover 51, the depression arrangement part 43 and protrusion arrangement part 56 fitted to each other are formed with a slight gap. Therefore, when the top end of the agitating member 63 moving on the internal contact face is moved on the boundary, the top end of the agitating member 63 is kept in a contact state with a face facing to the toner storing space 37 in the protrusion 57 of the protrusion arrangement part 56 (or a face facing to the toner storing space 37 between the adjacent depressions 44 of the depression arrangement part 43). It is possible to regard the face facing to the toner storing space 37 in the protrusion 57 of the protrusion arrangement part 56 (or the face facing to the toner storing space 37 between the adjacent depressions 44 of the depression arrangement part 43) as a part of the internal contact face. Ultimately, even if the top end of the agitating member 63 is moved on the boundary between the fitting step part 41 of the main body 31 and the fitting protrusion 54 of the cover 51, the top end of the agitating member 63 is kept into contact with the internal contact face.

Therefore, because there is no phenomenon that separates the top end of the agitating member 63 from the internal contact face for a moment and has the top end come into contact with it again, it is possible to prevent the noise called as the crack or flick. Moreover, in the boundary between the fitting step part 41 of the main body 31 and the fitting protrusion 54 of the cover 51, a straight line-liked gap consistently extending from the left end to the right end of the main body 31 in the left/right direction is not formed. Therefore, it is possible to prevent the damage of the agitating member 63 from occurring by inserting the top end of the agitating member 63 in such a straight line-liked gap.

Figure 8:
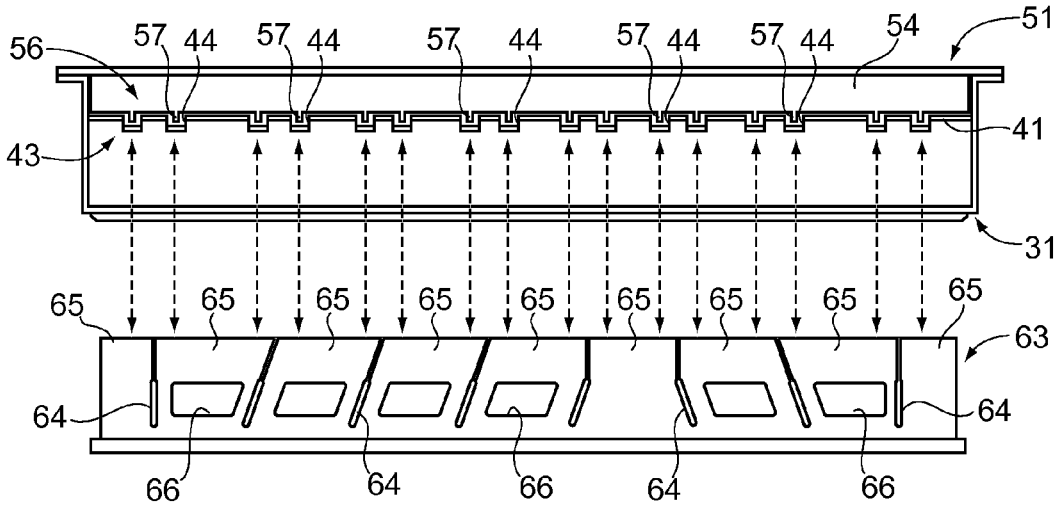
FIG. 8 is a schematic diagram schematically showing a location relation of plate pieces of an agitating member and protrusions of a protrusion arrangement part in the toner case according to the embodiment of the present disclosure.

In addition, between an arrangement of each protrusion 57 of the protrusion arrangement part 56 and an arrangement of each plate piece 65 of the agitating member 63, there is a given relation as shown in FIG. 8. That is, FIG. 8 illustrates the arrangement relation of each protrusion 57 of the protrusion arrangement part 56 and each plate piece 65 of the agitating member 63. As shown in FIG. 8, in the toner case 5 according to the embodiment, the arrangement of the plurality of the plate pieces 65 or the arrangement of the plurality of the protrusions 57 is determined so that each plate piece 65 of the agitating member 63 corresponds to at least one of the plurality of the protrusions 57 of the protrusion arrangement part 56. In the embodiment, for example, the most left plate piece 65 and the most right plate piece 65 of the agitating member 63 are determined so that one plate piece 65 corresponds to one protrusion 57. Then, the remaining seven plate pieces 65 of the agitating member 63 are determined so that one plate piece 65 corresponds to two protrusions 57.

By determining the arrangement of each protrusion 57 and each plate piece 65 as mentioned above, the top end side of each plate piece 65 of the agitating member 63 is moved on the internal contact face accompanying to the rotation of the rotating member 61, and meanwhile, passes through the boundary between the fitting step part 41 of the main body 31 and the fitting protrusion 54 of the cover 51. In this time, each plate piece 65 is kept in a contact state with a face facing to the toner storing space 37 of one or two protrusion(s) 57.

Therefore, because there is no phenomenon that separates the top end of the plate piece 65 from the internal contact face for a moment and has the top end come into contact with it again, it is possible to prevent the noise called as the crack or flick for every plate pieces 65. Moreover, each plate piece 65 cannot insert, because of the corresponding protrusion 57, in the boundary between the fitting step part 41 of the main body 31 and the fitting protrusion 54 of the cover 51. Therefore, it is possible to prevent the damage of the plate piece 65 from occurring by inserting the top end of the plate piece 65 in the boundary.

Figure 9:
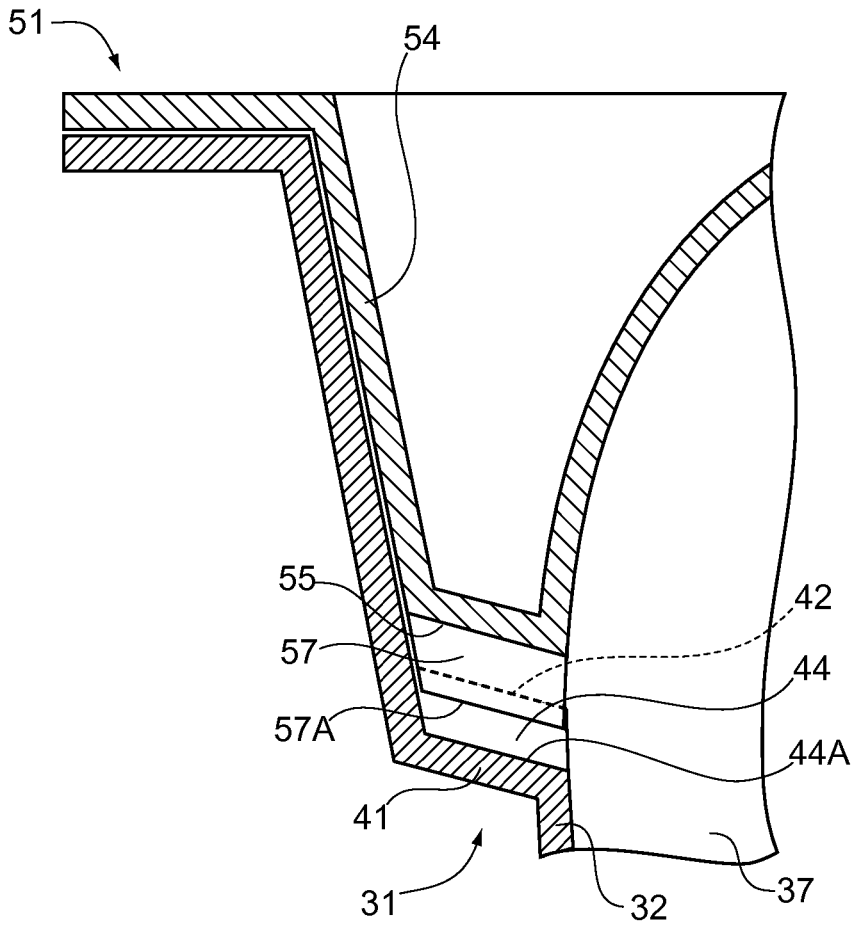
FIG. 9 is a sectional view showing the boundary between the main body and cover along line IX-IX of FIG. 7.

In the boundary between the fitting step part 41 of the main body 31 and the fitting protrusion 54 of the cover 51, a structure restraining insertion of the toner in the boundary and a residue of the toner in the boundary is formed. That is, FIG. 9 illustrates the boundary along line IX-IX of FIG. 7. As shown in FIG. 9, the upper face 42 of the fitting step part 41 of the main body 31, a bottom face 44A of each depression 44, the lower face 55 of the fitting protrusion 54 of the cover 51 and a protruded end face 57A of each protrusion 57 slope downward in a direction toward the toner storing space 37.

By the slopes of these faces, the toner stored in the toner storing space 37 is difficult to penetrate in the boundary between the fitting step part 41 of the main body 31 and the fitting protrusion 54 of the cover 51. Even if the toner penetrates in the boundary, the toner falls down from the boundary in the toner storing space 37 by gravity, thereby restraining the residue of the toner in the boundary.

The above-mentioned embodiment was described as a case of forming sixteen depressions 44 on the upper face 42 of the fitting step part 41 of the main body 31 and forming the same number of protrusions 57 on the lower face 55 of the fitting protrusion 54 of the cover 51. However, the number of the depressions 44 and protrusions 57 is not restricted to this case. For example, a small number, e.g. three, or a large number, e.g. seventeen or more may be applied. It is preferable to satisfy a condition that each plate piece 65 of the agitating member 63 corresponds to at least one of the plurality of the protrusions 57 of the protrusion arrangement part 56.

In the above-mentioned embodiment, as shown in FIG. 7, the slight gap is arranged between the depression arrangement part 43 and protrusion arrangement part 56. By arranging such a gap, it is possible to easily combine the main body 31 and cover 51. However, if compatibility of the main body 31 and cover 51 is satisfactory, this gap may be omitted.

In the above-mentioned embodiment, the depressions 44 are formed on the upper face 42 of the fitting step part 41 of the main body 31 and the protrusions 57 are formed on the lower face 55 of the fitting protrusion 54 of the cover 51. On the other hand, in another embodiment, the arrangements of the depressions 44 and protrusions 57 may be reversed to the above-mentioned embodiment. That is, the protrusions may be formed on the upper face 42 of the fitting step part 41 of the main body 31 and the depressions may be formed on the lower face 55 of the fitting protrusion 54 of the cover 51.

Although the above-mentioned embodiment was described as a case of forming the depression arrangement part 43 and protrusion arrangement part 56 in the boundary between the fitting step part 41 of the main body 31 and the fitting protrusion 54 of the cover 51, the present disclosure is not restricted to this case. Due to the structure of the toner case, if the top end of the agitating member 63 comes into contact with another boundary between the back wall 33 and cover 51 by the rotation of the rotating member 61, the depression arrangement part and protrusion arrangement part may be formed in the boundary between the back wall 33 and cover 51.

The present disclosure can be suitably changed within the summary or idea of the disclosure solved from the claims and specification and a technical idea of the present disclosure includes a toner case and an image forming apparatus with such a change.

What is claimed is:

1. A toner case comprising:

a main body including a first wall, a second wall facing to the first wall, a third wall extending in a direction crossing to the first wall and second wall, a fourth wall facing to the third wall, a bottom board, an opening at an upper side and a toner discharge port discharging a toner stored inside to an outside;

a cover attached to the upper side of the main body to close the opening;

a rotating member located in the main body to rotate around a rotation axis extending in a direction from the third wall to the fourth wall in the main body;

an agitating member including a base end side supported by the rotating member to rotate in the main body accompanying to a rotation of the rotating member, to agitate the toner stored in the main body by a top end side and to transmit the toner to the toner discharge port;

a protrusion arrangement part formed on one of an upper face formed in the first wall or the second wall so as to face upward and a lower face formed in the cover so as to face to the upper face to include a plurality of protrusions arranged in the direction from the third wall to the fourth wall; and a depression arrangement part formed on another of the upper face and lower face to include a plurality of depressions into which the plurality of protrusions insert, arranged in the direction from the third wall to the fourth wall, wherein a gap is formed between the protrusion arrangement part and the depression arrangement part.

2. The toner case according to claim 1, wherein at least the top end side of the agitating member is divided into a plurality of plate pieces arranged in the direction from the third wall to the fourth wall, and the plurality of protrusions of the protrusion arrangement part are arranged so that each one of the plate pieces comes into contact with at least one of the plurality of protrusions when the agitating member rotates.

3. The toner case according to claim 1, wherein the upper face, the lower face, a protruded end face of each protrusion of the protrusion arrangement part or a bottom face of each depression of the depression arrangement part slopes downward in a direction toward an inside of the main body.

4. The toner case according to claim 1, wherein the agitating member has flexibility, when the rotating member rotates, the top end of the agitating member is moved while keeping in contact with a wall, of the first wall and second wall, on which the protrusion arrangement part or the depression arrangement part is formed.

5. The toner case according to claim 1, further comprising a screw transmitting the toner transmitted by the agitating member to the toner discharge port.

6. The toner case according to claim 1, wherein, in the first wall or the second wall, a fitting step part straight-linearly extending in the direction from the third wall to the fourth wall is formed, and in the cover, a fitting protrusion straight-linearly extending in the direction from the third wall to the fourth wall and fitting to the fitting step part is formed.

7. The toner case according to claim 6, wherein, on the fitting step part, the upper face is formed, and on the fitting protrusion, the lower face is formed.

8. An image forming apparatus comprising:

the toner case according to claim 1.

9. The image forming apparatus according to claim 8, wherein at least the top end side of the agitating member is divided into a plurality of plate pieces arranged in the direction from the third wall to the fourth wall, and the plurality of protrusions of the protrusion arrangement part are arranged so that each one of the plate pieces comes into contact with at least one of the plurality of protrusions when the agitating member rotates.

10. The image forming apparatus according to claim 8, wherein the upper face, the lower face, a protruded end face of each protrusion of the protrusion arrangement part or a bottom face of each depression of the depression arrangement part slopes downward in a direction toward an inside of the main body.

11. The image forming apparatus according to claim 8, wherein the agitating member has flexibility, when the rotating member rotates, the top end of the agitating member is moved while keeping in contact with a wall, of the first wall and second wall, on which the protrusion arrangement part or the depression arrangement part is formed.

12. The image forming apparatus according to claim 8, further comprising a screw transmitting the toner transmitted by the agitating member to the toner discharge port.

13. The image forming apparatus according to claim 12, wherein the screw is supported by the cover.

14. The image forming apparatus according to claim 8, wherein, in the first wall or the second wall, a fitting step part straight-linearly extending in the direction from the third wall to the fourth wall is formed, and in the cover, a fitting protrusion straight-linearly extending in the direction from the third wall to the fourth wall and fitting to the fitting step part is formed.

15. The image forming apparatus according to claim 14, wherein, on the fitting step part, the upper face is formed, and on the fitting protrusion, the lower face is formed.

16. A toner case comprising:

a main body including a first wall, a second wall facing to the first wall, a third wall extending in a direction crossing to the first wall and second wall, a fourth wall facing to the third wall, a bottom board, an opening at an upper side and a toner discharge port discharging a toner stored inside to an outside;

a cover attached to the upper side of the main body to close the opening;

a rotating member located in the main body to rotate around a rotation axis extending in a direction from the third wall to the fourth wall in the main body;

an agitating member including a base end side supported by the rotating member to rotate in the main body accompanying to a rotation of the rotating member, to agitate the toner stored in the main body by a top end side and to transmit the toner to the toner discharge port;

a protrusion arrangement part formed on one of an upper face formed in the first wall or the second wall so as to face upward and a lower face formed in the cover so as to face to the upper face to include a plurality of protrusions arranged in the direction from the third wall to the fourth wall;

a depression arrangement part formed on another of the upper face and lower face to include a plurality of depressions into which the plurality of protrusions insert, arranged in the direction from the third wall to the fourth wall; and a screw transmitting the toner transmitted by the agitating member to the toner discharge port, wherein the screw is supported by the cover.

17. A toner case comprising:

a main body including a first wall, a second wall facing to the first wall, a third wall extending in a direction crossing to the first wall and second wall, a fourth wall facing to the third wall, a bottom board, an opening at an upper side and a toner discharge port discharging a toner stored inside to an outside;

a cover attached to the upper side of the main body to close the opening;

a rotating member located in the main body to rotate around a rotation axis extending in a direction from the third wall to the fourth wall in the main body;

an agitating member including a base end side supported by the rotating member to rotate in the main body accompanying to a rotation of the rotating member, to agitate the toner stored in the main body by a top end side and to transmit the toner to the toner discharge port;

a protrusion arrangement part formed on one of an upper face formed in the first wall or the second wall so as to face upward and a lower face formed in the cover so as to face to the upper face to include a plurality of protrusions arranged in the direction from the third wall to the fourth wall; and a depression arrangement part formed on another of the upper face and lower face to include a plurality of depressions into which the plurality of protrusions insert, arranged in the direction from the third wall to the fourth wall, wherein the agitating member has flexibility, when the rotating member rotates, the top end of the agitating member is moved while keeping in contact with an internal contact face arranged in an internal face of the main body and an internal face of the cover, and the protrusion arrangement part and the depression arrangement part are formed in a boundary between the upper face and the lower face, the boundary exposed to the internal contact face.

* * * * *